US007121117B2

(12) United States Patent
Gruosi-Scheufele

(10) Patent No.: US 7,121,117 B2
(45) Date of Patent: Oct. 17, 2006

(54) PIECE OF JEWELRY

(75) Inventor: Caroline Gruosi-Scheufele, Prangins (CH)

(73) Assignee: Chopard International SA, Prangins (CH)

( * ) Notice: Subject to any disclaimer, the term of this patent is extended or adjusted under 35 U.S.C. 154(b) by 0 days.

(21) Appl. No.: 10/788,323

(22) Filed: Mar. 1, 2004

(65) Prior Publication Data

US 2004/0194501 A1 Oct. 7, 2004

(30) Foreign Application Priority Data

Apr. 1, 2003 (CH) ..... 581/03

(51) Int. Cl.

| | |
|---|---|
| ***A44C 13/00*** | (2006.01) |
| ***A44C 7/00*** | (2006.01) |
| ***A44C 15/00*** | (2006.01) |
| ***A44C 25/00*** | (2006.01) |

(52) U.S. Cl. ..... 63/1.14; 63/1.11; 63/1.18; 63/13; 63/31; 63/23; 63/18

(58) Field of Classification Search ..... 63/1.14, 63/1.11, 1.18, 13, 31, 23, 18; D11/79
See application file for complete search history.

(56) References Cited

U.S. PATENT DOCUMENTS

| | | | | | |
|---|---|---|---|---|---|
| 692,650 | A | * | 2/1902 | Fisher | 206/1.5 |
| 1,732,250 | A | * | 10/1929 | Wehse | 63/14.2 |
| 2,931,196 | A | * | 4/1960 | Liftman | 63/31 |
| 3,485,061 | A | * | 12/1969 | Irving | 63/19 |
| 4,028,908 | A | * | 6/1977 | Michael | 63/23 |
| 4,091,639 | A | * | 5/1978 | Benda | 63/18 |
| D256,003 | S | * | 7/1980 | Barr | D11/43 |
| D257,018 | S | * | 9/1980 | Barr | D11/27 |
| D301,318 | S | * | 5/1989 | Yoshida | D11/79 |
| 4,841,746 | A | * | 6/1989 | Chen | 63/15 |
| D308,348 | S | * | 6/1990 | Leopoldi | D11/43 |
| 4,939,913 | A | * | 7/1990 | Scungio et al. | 63/21 |
| 5,235,824 | A | * | 8/1993 | Huang | 63/20 |
| 6,196,025 | B1 | * | 3/2001 | Moshkovitz | 63/23 |
| 6,226,232 | B1 | * | 5/2001 | Ruchonnet | 368/223 |
| D497,322 | S | * | 10/2004 | Gruosi-Scheufele | D11/79 |

FOREIGN PATENT DOCUMENTS

| | | |
|---|---|---|
| CH | 692 017 | 1/2002 |
| EP | 0 963 299 | 12/1999 |
| FR | 2 338 007 | 8/1977 |
| WO | WO 98/28668 | 7/1998 |
| WO | WO 02/082940 | 10/2002 |

OTHER PUBLICATIONS http://www.chopard.com/worldwide/indexfl.html.*

* cited by examiner

*Primary Examiner*—Robert J. Sandy
*Assistant Examiner*—David Reese
(74) *Attorney, Agent, or Firm*—Young & Thompson

(57) ABSTRACT

A piece of jewelry includes an enclosure formed by a frame and by two parallel crystals connected to the frame in a sealed manner. A plurality of independent annular elements are placed inside the enclosure one within another. These annular elements are free to move in rotation and in translation within the enclosure and one within another.

20 Claims, 2 Drawing Sheets

PIECE OF JEWELRY

BACKGROUND OF THE INVENTION

The present invention relates to a piece of jewelry, and more particularly to a pendant, a brooch, a ring, an earring, or some other article of adornment.

An object of the present invention is to provide a piece of jewelry that is attractive, i.e. having mobile portions capable of taking up different configurations, thereby increasing the attractiveness of the piece of jewelry.

DESCRIPTION OF THE RELATED ART

Document WO 02/082940 discloses a ring comprising an enclosure subdivided into a plurality of separate chambers, each of the chambers containing one or more precious or semi-precious stones capable of moving freely in the chamber enclosing them.

Document FR 2 338 007 discloses a pendant having an annular mount with faces that are closed by transparent plates. The enclosure is filled in part with a powder material.

SUMMARY OF THE INVENTION

An object of the present invention is to provide a pendant, an earring, or a brooch, in particular, that is not limited to presenting precious or semi-precious stones or a powder material in a random circle, but that enables a geometrical shape to be represented while still remaining mobile.

BRIEF DESCRIPTION OF THE DRAWINGS

The accompanying drawing is a diagram by way of example of an embodiment of a piece of jewelry in accordance with the present invention.

DESCRIPTION OF THE PREFERRED EMBODIMENTS

Figure 1:
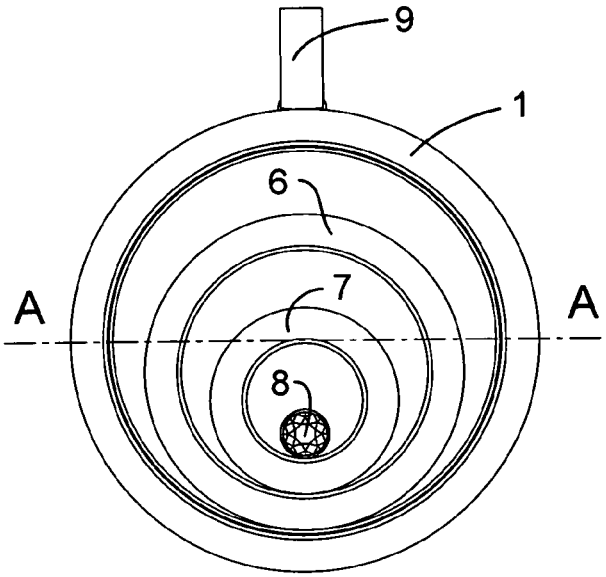
FIG. 1 is a plan view of a pendant of the invention in its normal position when suspended vertically.
Figure 2:
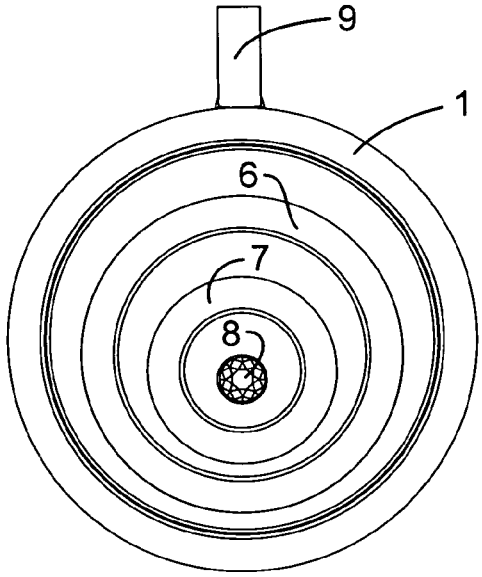
FIG. 2 is a plan view of the FIG. 1 pendant, but when lying on a horizontal surface.
Figure 3:
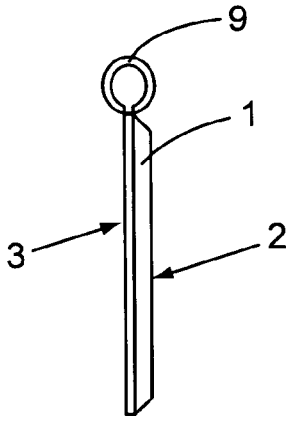
FIG. 3 is an elevation side view of the pendant shown in FIG. 1.
Figure 4:
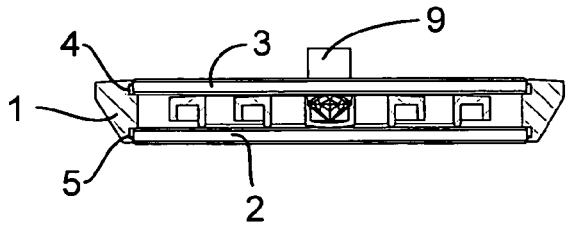
FIG. 4 is a section view on line A—A through the pendant shown in FIG. 1.

In the embodiment shown, the piece of jewelry is a pendant, however other pieces could be implemented such as brooches, earrings, rings, or other ornaments that differ from pendants in their manner of fixing, for example, as well as jewelry watches.

The first embodiment of the piece of jewelry as shown in FIGS. 1 to 4 is a pendant of circular shape presenting annular and circular mobile elements. The pendant comprises a sealed enclosure formed by an annular frame 1 or "middle" whose two faces are closed by transparent plates or "crystals" 2, 3 driven into the frame, with the enclosure being sealed by gaskets 4, 5.

The cylindrical inside space of this enclosure contains mobile decorative elements constituted in this case by two rings 6, 7 situated one inside the other, and a diamond 8 set in a collet situated inside the inner ring 7.

The thickness of the decorative elements, i.e. the rings 6, 7 and the diamond 8, is smaller than the distance between the crystals 2, 3 so that these decorative elements can move freely in rotation and in translation one within another and all inside the enclosure, without being subjected to excessively high friction forces.

This thickness for the decorative elements 6, 7 may be less than the distance between the crystals 2, 3 by 0.1 millimeters (mm) to 0.5 mm, for example, since it is also important to ensure that these elements cannot depart too far from a plane parallel to the crystals 2, 3.

All of the decorative elements 6, 7, which may be present in a number greater than two, in particular three or four, are in the form of circular rings while the central element 8 is solid.

The appearance of the piece of jewelry changes as a function of its position, the rings 6, 7 and the diamond 8 rolling inside the enclosure and one inside another, and also being capable of moving in translation relative to one another. This can be seen particularly in FIG. 2 where the piece of jewelry is placed on a horizontal surface and where the decorative elements are occupying a random position.

In this embodiment of a piece of jewelry, the enclosure includes a suspension loop 9 in which a chain may pass.

If the piece of jewelry is a brooch, then the loop 9 can be replaced by some other fixing means, e.g. a pin.

In a variant, one of the crystals 2, 3, specifically the rear crystal 3, may be replaced by a metallic, opaque wall or a mirror, for example.

Figure 5:
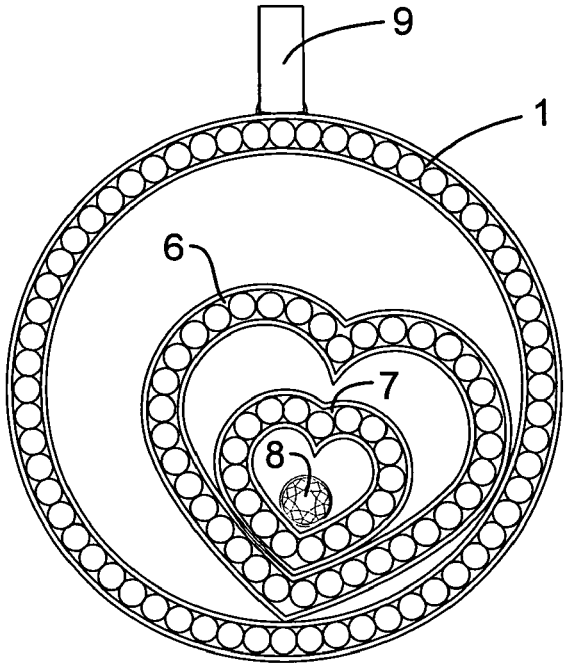
FIGS. 5 to 7 are plan views showing variants of the pendant shown in FIG. 1.
Figure 6:
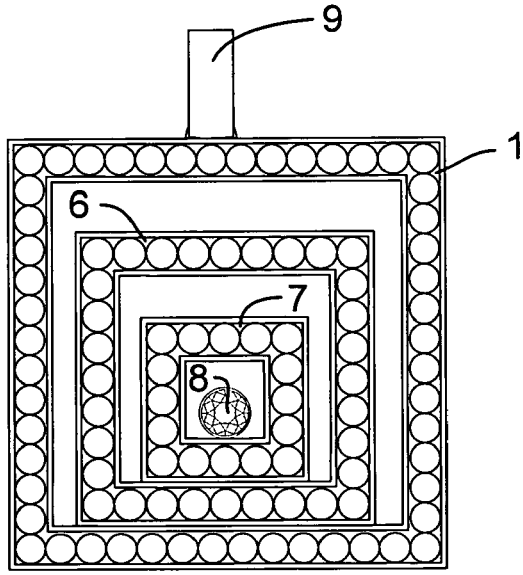
Figure 7:
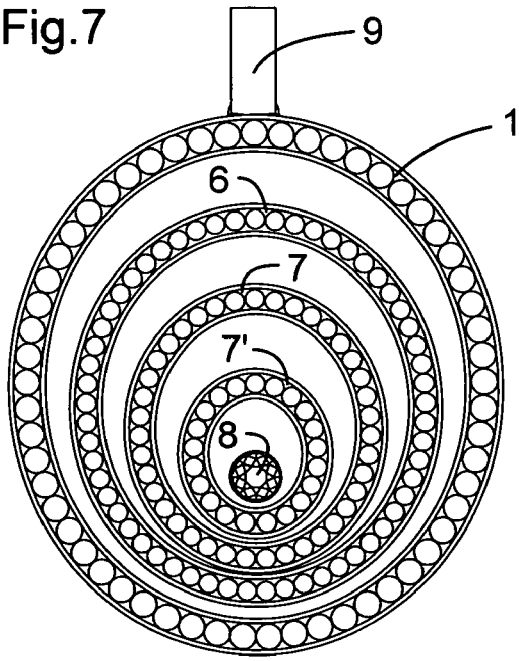

In the embodiments shown in FIGS. 5 to 7, the annular mobile elements 6, 7 are not circular in shape, being respectively heart-shaped, square, and oval. Other polygonal or curved shapes could also be envisaged, triangles or other polygons, cloverleaf-shaped, etc.

The frame 1 of the enclosure forming the piece of jewelry is preferably either circular or else of a shape that matches that of the mobile elements 6, 7 included inside the enclosure.

The annular mobile elements housed within an enclosure are preferably two to three in number, but they could be more numerous.

The frame 1 of the piece of jewelry, as well as the annular mobile elements 6, 7, are generally made of metal, of steel, or of precious metal, gold, silver, or platinum.

All of the annular elements 6, 7 of a piece of jewelry are preferably of the same circular, polygonal, etc. shape, however it is also possible to place within a same enclosure annular elements one within the other, with the elements being of shapes that are different from one another.

In section, the annular mobile elements 6, 7 are generally U-shaped with one of the flanges being shorter than the other.

In FIGS. 5 and 6, the frame and the mobile elements that are respectively heart-shaped and square are studded with diamonds.

The frame 1 preferably presents the same shape as the mobile elements situated inside the enclosure; nevertheless, mobile elements of a shape different from that of the frame can be envisaged as shown in FIG. 5 where the frame 1 is circular while the mobile elements are heart-shaped.

Generally, the piece of jewelry is worn vertically as is the case for a pendant, earrings, or a brooch. Under such circumstances, the mobile elements are subjected to gravity and they touch one another at points on their circumferences and the mobile element of largest size rests against the inside face of the frame at a point. Because the person wearing the piece of jewelry moves, the mobile elements move inside the enclosure giving a playful and attractive side to the piece of jewelry.

For pieces of jewelry having in-set stones, the frame and all or some of the mobile elements may be set with stones of the same kind or with stones of different colors.

Since the enclosure 1 is sealed, its inside does not become dirtied with water or dust. Sealing that can withstand a pressure of 1 bar to 3 bars is provided so that the user can continue to wear the piece of jewelry even while bathing.

The invention claimed is:

1. A piece of jewelry, comprising:

an enclosure comprising a frame and two parallel faces, at least one of said faces being transparent, said faces being connected to said frame; and plural independent annular mobile elements contained inside said enclosure and placed, freely mobile, one within another, said plural annular mobile elements being free to move in rotation and in translation inside said enclosure and each of said plural annular mobile elements being free to move in rotation and in translation with respect to all other ones of said plural annular mobile elements.

2. A piece of jewelry according to claim 1, further comprising a solid mobile element constituted by a precious or semiprecious stone mounted in a collet, said solid mobile element being situated inside a smallest one of said annular mobile elements.

3. A piece of jewelry according to claim 1, wherein the frame and the annular mobile elements are made of precious metal.

4. A piece of jewelry according to claim 1, wherein the annular mobile elements are generally circular in shape in plan view.

5. A piece of jewelry according to claim 1, wherein the annular mobile elements are generally oval in shape in plan view.

6. A piece of jewelry according to claim 1, wherein the annular mobile elements are generally polygonal in shape in plan view.

7. A piece of jewelry according to claim 1, wherein the annular mobile elements are curved in shape in plan view.

8. A piece of jewelry according to claim 1, wherein the enclosure is sealed, being formed by the frame and two parallel crystals driven into the frame.

9. A piece of jewelry according to claim 1, further including a suspension loop fixed to the frame.

10. A piece of jewelry according to claim 1, further including a fixing pin fixed to the frame.

11. A piece of jewelry according to claim 1, wherein a cross-section of the annular mobile elements are generally U-shaped with one flange being shorter than another flange.

12. A piece of jewelry according to claim 1, wherein the frame presents a same shape in plan view as the mobile elements placed inside the enclosure.

13. A piece of jewelry according to claim 1, wherein the frame in plan view is of a shape that is different from that of at least some of the mobile elements.

14. A piece of jewelry according to claim 1, wherein all of the mobile elements are of a same shape.

15. A piece of jewelry according to claim 1, wherein the mobile elements present different shapes.

16. A piece of jewelry according to claim 1, wherein the annular mobile elements are one of heart-shaped and clover-shaped.

17. A piece of jewelry, comprising:

an enclosure comprising a frame and two parallel faces, at least one of said faces being transparent, said faces being connected to said frame; and a first annular mobile element contained inside said enclosure and free to move in rotation and in translation inside said enclosure; and a second annular mobile element contained inside said first annular mobile element, free to move in rotation and in translation inside said enclosure, and free to move in rotation and in translation inside said first annular mobile element.

18. The piece of jewelry of claim 17, further comprising:

a third annular mobile element contained inside said second annular mobile element, free to move in rotation and in translation inside said enclosure, free to move in rotation and in translation inside said first annular mobile element, and free to move in rotation and in translation inside said second annular mobile element.

19. The piece of jewelry of claim 18, further comprising a solid mobile element constituted by a precious or semi-precious stone mounted in a collet, said solid mobile element being situated inside the third annular mobile element.

20. The piece of jewelry of claim 18, wherein, the annular mobile elements are one of:

i) generally circular in shape in plan view, ii) generally oval in shape in plan view, iii) generally polygonal in shape in plan view, and iv) curved in shape in plan view.

* * * * *